US010632336B2

(12) United States Patent
Townsend et al.

(10) Patent No.: US 10,632,336 B2
(45) Date of Patent: Apr. 28, 2020

(54) BATTLE ROPE COVER

(71) Applicants: Phyllis Eugenia Townsend, Silver Creek, GA (US); Thomas Ryan Worthey, Rome, GA (US)

(72) Inventors: Phyllis Eugenia Townsend, Silver Creek, GA (US); Thomas Ryan Worthey, Rome, GA (US)

( * ) Notice: Subject to any disclaimer, the term of this patent is extended or adjusted under 35 U.S.C. 154(b) by 87 days.

(21) Appl. No.: 16/141,289

(22) Filed: Sep. 25, 2018

(65) Prior Publication Data

US 2019/0388722 A1 Dec. 26, 2019

Related U.S. Application Data

(60) Provisional application No. 62/690,076, filed on Jun. 26, 2018.

(51) Int. Cl.

| | |
|---|---|
| ***A63B 21/055*** | (2006.01) |
| ***A63B 21/00*** | (2006.01) |
| *A63B 21/04* | (2006.01) |
| *A63B 23/02* | (2006.01) |
| *A63B 23/04* | (2006.01) |

(52) U.S. Cl.

CPC ..... *A63B 21/0557* (2013.01); *A63B 21/151* (2013.01); *A63B 21/4035* (2015.10); *A63B 21/0442* (2013.01); *A63B 23/0205* (2013.01); *A63B 23/0233* (2013.01); *A63B 2023/0411* (2013.01); *A63B 2208/0204* (2013.01)

(58) Field of Classification Search

CPC ..... A63B 21/0557; A63B 21/151; A63B 21/4035; A63B 23/0205; A63B 2208/0204; A63B 2023/0411; A63B 23/0233; A63B 21/0442; Y10T 24/39; Y10T 24/398; Y10T 24/31; Y10T 24/314; Y10T 24/316; Y10T 24/318; B65D 65/02; B65D 65/04; B65D 65/22; D07B 2201/20903; D07B 2201/20907; D07B 2401/2075; D07B 2201/2083

See application file for complete search history.

(56) References Cited

U.S. PATENT DOCUMENTS

| | | | | |
|---|---|---|---|---|
| 5,901,756 | A | 5/1999 | Goodrich | |
| 6,050,077 | A | 4/2000 | Muller | |
| 6,916,992 | B1 | 7/2005 | Ortiz | |
| 7,216,678 | B2 | 5/2007 | Baer | |
| 7,325,575 | B1 | 2/2008 | O'Donnell et al. | |
| 8,042,232 | B2 * | 10/2011 | Mask ..... | B65D 63/10 24/16 R |
| 8,205,314 | B1 | 6/2012 | Dermody, IV | |
| 8,231,510 | B2 | 7/2012 | Abdo | |
| 8,283,563 | B2 | 10/2012 | Harris et al. | |
| 8,502,069 | B2 | 8/2013 | Holland et al. | |
| 8,752,590 | B2 | 6/2014 | Petty et al. | |
| 9,675,843 | B2 | 6/2017 | Petty et al. | |
| 9,808,666 | B1 | 11/2017 | Burkinshaw | |
| 2002/0170727 | A1 | 11/2002 | Holland et al. | |

(Continued)

*Primary Examiner* — Robert Sandy

(74) *Attorney, Agent, or Firm* — Dunlap Bennett & Ludwig PLLC

(57) ABSTRACT

An elongated cover that fits around a battle rope. The cover includes a tube shape made of a fabric material. The cover further includes a first open end opposite a second open end. A first cinch is coupled to the cover at the first open end and a second cinch is coupled to the cover at the second open end.

6 Claims, 2 Drawing Sheets

(56) References Cited

U.S. PATENT DOCUMENTS

| | | | |
|---|---|---|---|
| 2010/0005773 | A1 | 1/2010 | Lim |
| 2014/0113777 | A1 | 4/2014 | Pahl |
| 2015/0119206 | A1 | 4/2015 | Newman |
| 2015/0267347 | A1 | 9/2015 | Farmer |
| 2018/0078824 | A1 | 3/2018 | Norton |

* cited by examiner

BATTLE ROPE COVER

CROSS-REFERENCE TO RELATED APPLICATION

This application claims the benefit of priority of U.S. provisional application No. 62/690,076, filed Jun. 26, 2018, the contents of which are herein incorporated by reference.

BACKGROUND OF THE INVENTION

The present invention relates to preserving battle ropes and, more particularly, to a protective outer cover to prevent fraying of battle ropes.

Battle ropes are currently used during exercise. A battle rope is an elongated rope that typically has a diameter between one and a half inches and two inches. The elongated rope further includes a handle potion at each opposing end. The battle rope workouts typically involve grasping the handles of the battle rope and swing the battle rope up and down. The battle rope workouts work the muscles in your abs, back and glutes. During use, battle ropes tend to fray and come apart prematurely.

As can be seen, there is a need for a protective outer cover to prevent fraying of battle ropes.

SUMMARY OF THE INVENTION

In one aspect of the present invention, a method for protecting a battle rope comprising steps of: providing a cover comprising a tube shape made of a fabric material and having a first open end opposite a second open end, wherein a first cinch is coupled to the cover at the first open end and a second cinch is coupled to the cover at the second open end; providing a battle rope comprising a first end opposite a second end, and comprising a first handle disposed at the first end and a second handle disposed at the second end; inserting the battle rope into the cover such that the first handle is extending out of the first open end, and the second handle is extending out of the second open end; and tightening the first cinch around the battle rope and tightening the second cinch around the battle rope.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a fabric covering for a battle rope used for protection and as decoration. The present invention prevents fraying and shedding of the rope and thereby prevents the need to clean-up after use of battle rope. The covering protects the battle rope during use and adds to the longevity of the equipment. The present invention may also be customized for any size and length of rope.

Figure 1:
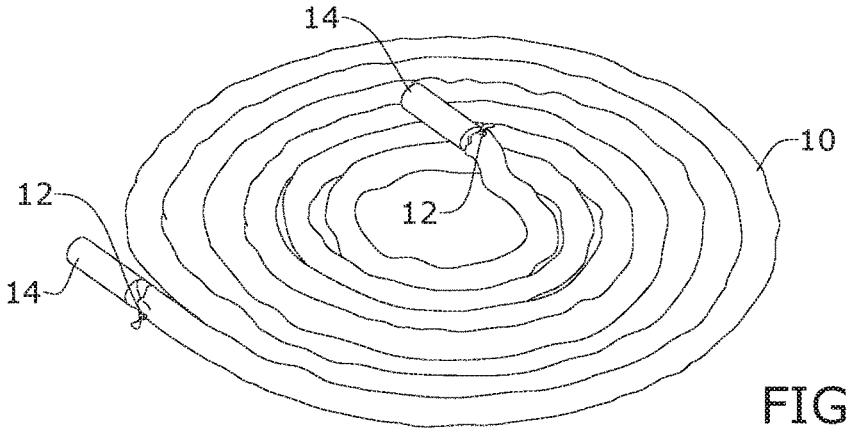
FIG. 1 is a perspective view of an embodiment of the present invention.
Figure 2:
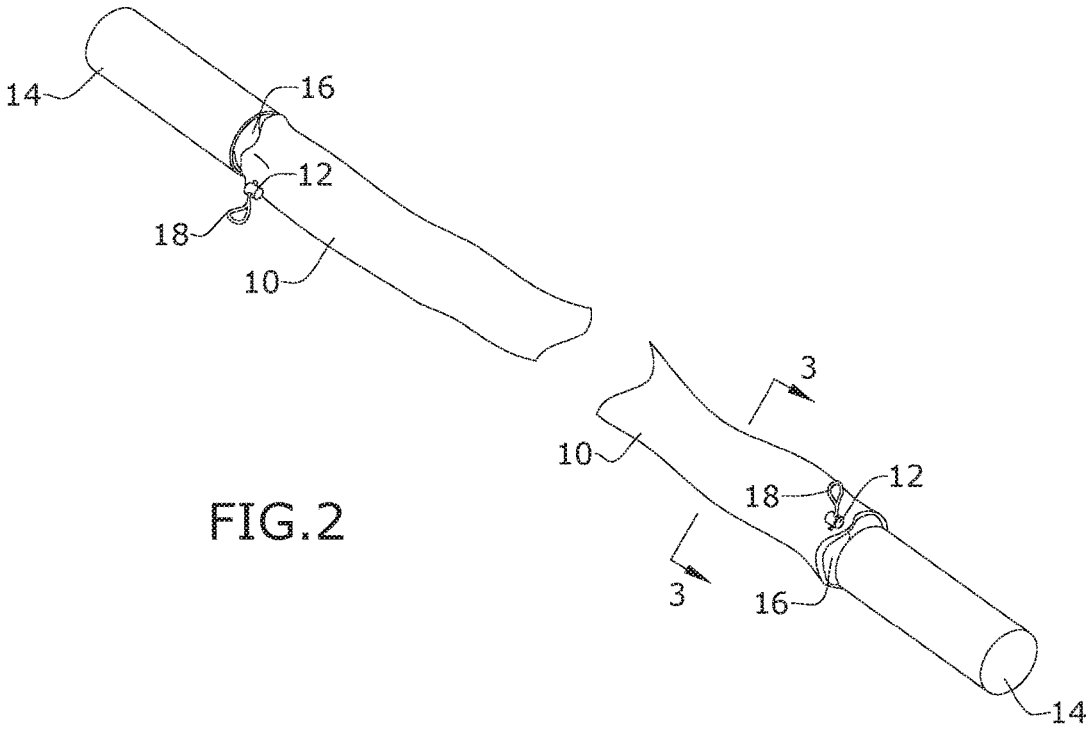
FIG. 2 is a detailed perspective view of an embodiment of the present invention.
Figure 3:
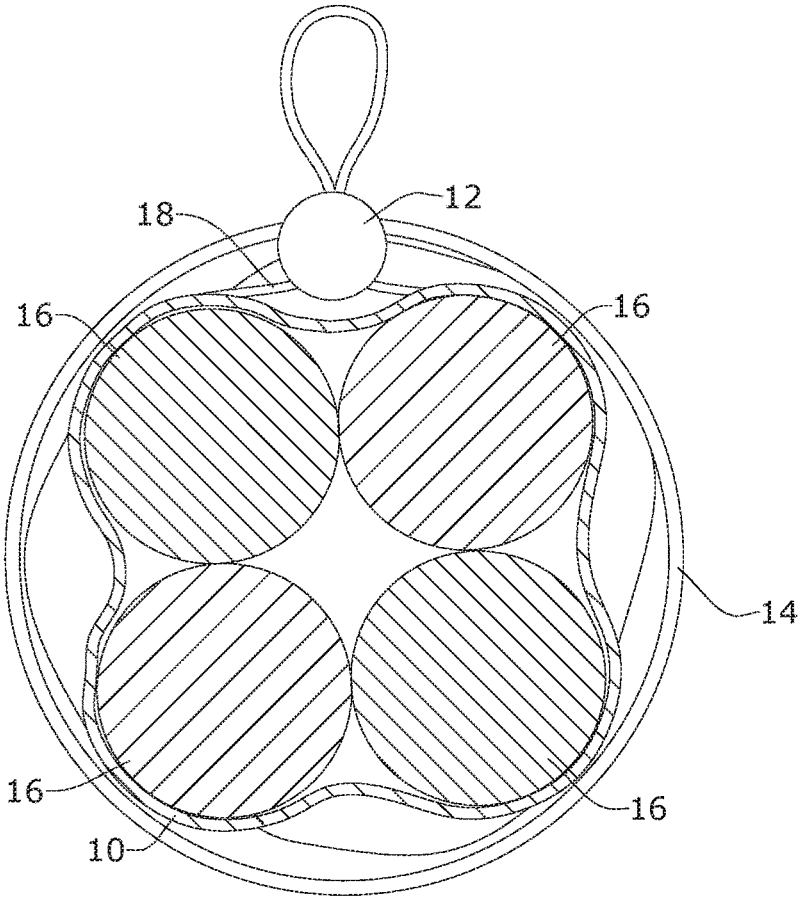
FIG. 3 is a section view taken along line 3-3 in FIG. 2.
Figure 4:
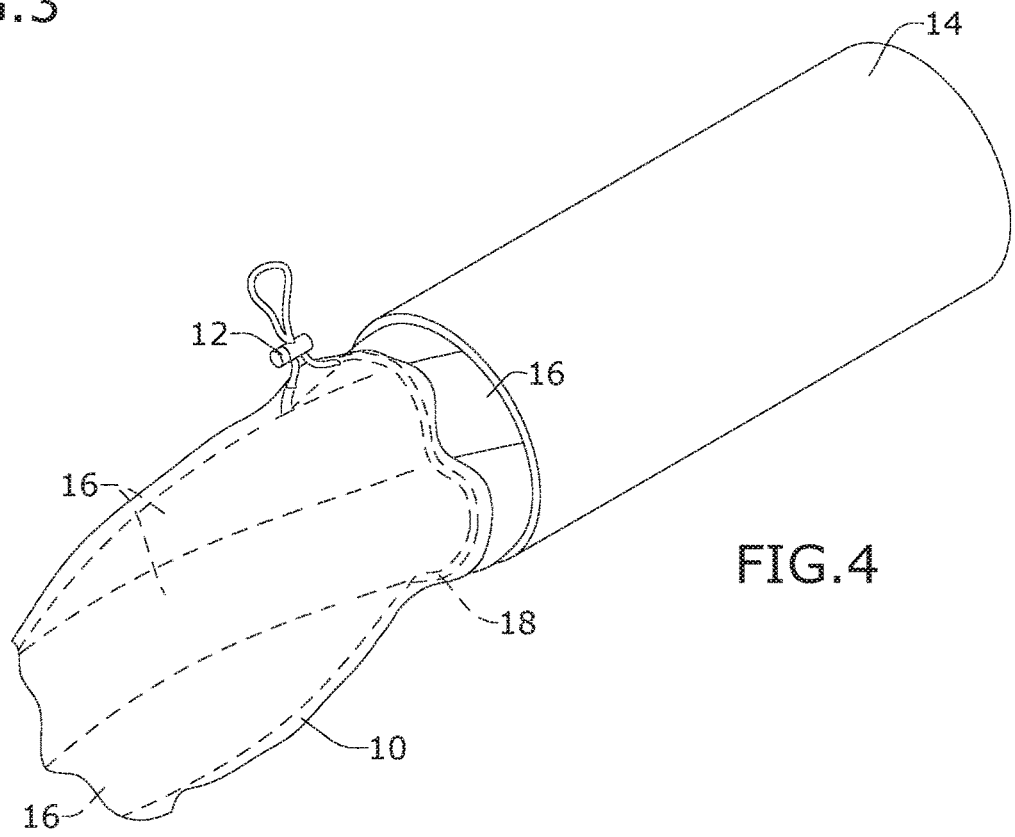
FIG. 4 is a detailed perspective view of an embodiment of the present invention.

Referring now to the FIG. 1 through 4, the present invention includes an elongated cover 10 that fits around a battle rope 16. The cover 10 includes a tube shape made of a fabric material, such as nylon, polyester, cotton ripstop, or other natural and synthetic fabric materials. The cover 10 further includes a first open end opposite a second open end. A first cinch 12,18 is coupled to the cover 10 at the first open end and a second cinch 12,18 is coupled to the cover 10 at the second open end. The cover 10 may further include different colors and patterns as desired by a user.

The battle rope 16 includes an elongated rope having a first end opposite a second end. The first end includes a first handle 14 and the second end includes a second handle 14. Each of the handles 14 may include a cylinder shape having a common longitudinal axis with the remainder of the rope 16. The battle rope 16 may include a diameter of about 1 inch up to about 3 inches and a length of about 20 feet up to about 60 feet.

The battle rope 16 is inserted into the cover 10 such that the first handle 14 is extending out of the first open end, and the second handle 14 is extending out of the second open end. The first cinch 12, 18 is then tightened around the battle rope 16 and the second cinch 12, 18 is tightened around the battle rope 16, thereby connecting the cover 10 to the battle rope 16. The cover 10 is disposed over more than half of the battle rope 16.

In certain embodiments, the first cinch 12, 18 and the second cinch 12, 18 each include a looped elastic cord 18 disposed around the cover 14 and a spring clip 12 compressing the elastic cord 18 against itself. For example, the cover 12 may include an opening. A portion of the looped elastic cord 18 may protrude through the opening and a remainder of the looped elastic cord 18 is disposed within a sleeve sewn to an inner surface of the cover 14. The spring clip 12 may be secured around the portion of the looped elastic cord 18 that protrudes outside of the cover 14. The spring clip 12 may be compressed to unclip from the elastic cord 18, the elastic cord 18 may be pulled to tighten around the rope 16, and the spring clip 12 is then released to tighten against the elastic cord 18. The cinches 12, 18 may also include different connectors, such as clips, ties, hook and loop fasteners, and the like.

The present invention further includes a method for protecting a battle rope including the steps of: providing a cover having a tube shape made of a fabric material and having a first open end opposite a second open end, with a first cinch coupled to the cover at the first open end and a second cinch coupled to the cover at the second open end; providing a battle rope including a first end opposite a second end, and including a first handle disposed at the first end and a second handle disposed at the second end; inserting the battle rope into the cover such that the first handle is extending out of the first open end, and the second handle is extending out of the second open end; and tightening the first cinch around the battle rope and tightening the second cinch around the battle rope. By covering the battle rope with the cover, the present invention prevents the shedding of the ropes while in use.

It should be understood, of course, that the foregoing relates to exemplary embodiments of the invention and that modifications may be made without departing from the spirit and scope of the invention as set forth in the following claims.

What is claimed is:

1. A method for protecting a battle rope comprising steps of:

providing a cover comprising a tube shape made of a fabric material and having a first open end opposite a second open end, wherein a first cinch is coupled to the cover at the first open end and a second cinch is coupled to the cover at the second open end;

providing a battle rope comprising a first end opposite a second end, and comprising a first handle disposed at the first end and a second handle disposed at the second end;

inserting the battle rope into the cover such that the first handle is extending out of the first open end, and the second handle is extending out of the second open end; and tightening the first cinch around the battle rope and tightening the second cinch around the battle rope.

2. The method of claim 1, wherein the first cinch and the second cinch each comprise an elastic cord disposed around the cover and a spring clip compressing the elastic cord against itself.

3. The method of claim 1, wherein the cover is disposed over more than half of the battle rope.

4. The method of claim 1, wherein the battle rope comprises a diameter of about 1 inch up to about 3 inches.

5. The method of claim 1, wherein the battle rope comprises a length of about 20 feet up to about 60 feet.

6. The method of claim 1, wherein the first handle and the second handle each having a cylinder shape having a common longitudinal axis with a remainder of the battle rope.

* * * * *